US007285711B2

(12) United States Patent
Okada et al.

(10) Patent No.: US 7,285,711 B2
(45) Date of Patent: Oct. 23, 2007

(54) MUSIC PLAYER

(75) Inventors: Toshiharu Okada, Tokyo (JP); Kaoru Tsukamoto, Tokyo (JP); Tomohiro Iwanaga, Tokyo (JP); Yoji Hamano, Tokyo (JP)

(73) Assignee: Oki Electric Industry, Co., Ltd., Tokyo (JP)

( * ) Notice: Subject to any disclaimer, the term of this patent is extended or adjusted under 35 U.S.C. 154(b) by 255 days.

(21) Appl. No.: 11/205,123

(22) Filed: Aug. 17, 2005

(65) Prior Publication Data

US 2006/0130638 A1 Jun. 22, 2006

(30) Foreign Application Priority Data

Dec. 20, 2004 (JP) ..... 2004-367544

(51) Int. Cl.
*G04B 13/00* (2006.01)
*G10H 7/00* (2006.01)

(52) U.S. Cl. ..... 84/609; 84/649

(58) Field of Classification Search ..... None
See application file for complete search history.

(56) References Cited

U.S. PATENT DOCUMENTS 4,387,617 A * 6/1983 Kato et al. ..... 84/615
5,602,841 A * 2/1997 Lebizay et al. ..... 370/413
5,763,805 A * 6/1998 Yamabata et al. ..... 84/645
5,862,136 A * 1/1999 Irwin ..... 370/395.4
5,955,691 A * 9/1999 Suzuki et al. ..... 84/604

FOREIGN PATENT DOCUMENTS

JP 2001-051678 2/2001
WO WO 01/11603 A1 2/2001

* cited by examiner

*Primary Examiner*—Marlon Fletcher
(74) *Attorney, Agent, or Firm*—Takeuchi & Kubotera, LLP

(57) ABSTRACT

A music player has sequencers each including a reading and restoring function unit for reading music information including header information, a delta time, and a message and restoring running status of the message; a message analyzing and processing function unit for analyzing the header information, consuming a period of time according to the delta time, and processing the message to generate sound source drive information; a writing function unit for writing the sound source drive information into an output memory; and a sequencer controlling function unit for controlling the reading and restoring function unit to read and restore the music information, controlling the message analyzing and processing function unit to analyze the header information, and controlling the message analyzing and processing function unit and the writing function unit to consume the period of time, generate the sound source drive information, and write the sound source drive information.

8 Claims, 7 Drawing Sheets

FIG. 7(A)

READING AND RESTORING FUNCTION UNIT

| | ANALYSIS AND PROCESS STATUS TO BE MAINTAINED | DATA TO BE MAINTAINED |
|---|---|---|
| 1 | IN READING HEADER INFORMATION | READ BITE NUMBER |
| 2 | IN READING DELTA TIME | READ BITE NUMBER |
| 3 | IN READING MESSAGE (TYPE UNIDENTIFIED) | READ BITE NUMBER |
| 4 | IN READING MESSAGE (2-BITE MESSAGE) | READ BITE NUMBER |
| 5 | IN READING MESSAGE (3-BITE MESSAGE) | READ BITE NUMBER |
| 6 | IN READING MESSAGE (META EVENT) | READ BITE NUMBER |
| 7 | IN READING MESSAGE (SYSTEM EXCLUSIVE MESSAGE) | READ BITE NUMBER |

FIG. 7(B)

MESSAGE ANALYZING AND PROCESSING FUNCTION UNIT

| | ANALYSIS AND PROCESS STATUS TO BE MAINTAINED | DATA TO BE MAINTAINED |
|---|---|---|
| 1 | IN CONSUMING TIME | CONSUMED TIME |

FIG. 7(C)

SEQUENCER CONTROLLING FUNCTION UNIT

| | ANALYSIS AND PROCESS STATUS TO BE MAINTAINED | DATA TO BE MAINTAINED |
|---|---|---|
| 1 | IN READING HEADER INFORMATION | NON |
| 2 | IN READING DELTA TIME | NON |
| 3 | IN CONTROLLING TIMING | NON |
| 4 | IN READING MESSAGE | NON |
| 5 | IN WRITING SOUND SOURCE DRIVE INFORMATION | NON |

MUSIC PLAYER

BACKGROUND OF THE INVENTION AND RELATED ART STATEMENT

The present invention relates to a music player for playing music data such as musical instrument digital interface (MIDI) data. The music player of the invention is applicable to a mobile phone, a personal digital assistance (PDA), a game player, and a MIDI player.

MIDI has been known as technology for playing music using music data. Patent Reference 1 has disclosed the MIDI technology. There has been known a MIDI player capable of playing MIDI data in a plurality of channels concurrently. With a MIDI player capable of playing a plurality of channels, it is possible to play, for example, a melody and background music at the same time.

In a conventional MIDI player capable of playing a plurality of channels, an input first-in-first-out (FIFO), a sequencer, an output FIFO, and a sound source are provided in each of the channels. The sequencer analyzes and processes content of an MIDI message, and converts the content to information (sound source drive information) for driving the sound source. In general, the sequencer is formed of software with a single central processing unit (CPU) in the MIDI player.

An MIDI message typically has a different length of data depending on a type of message, and may even have a variable length of data. Accordingly, each sequencer analyzes and processes in a different sequence for a different period of time. For example, when one sequencer complete a process for a single MIDI message and moves to a next process, another sequencer may not yet complete a process of another single MIDI message.

Accordingly, in the MIDI player capable of playing a plurality of channels, it may be necessary to stop another sequencer and move the one sequencer to the next process. If the one sequencer waits until another sequencer completes the process of another MIDI message, it is necessary to stop the one sequencer in the middle, thereby making it difficult to smoothly play the MIDI data.

Therefore, when a single CPU operates several sequencers in a plurality of channels, it is necessary to properly control the sequencers to analyze and process, and to maintain a state when a sequencer stops processing in the middle. As described above, the MIDI messages contain different contents with different lengths. Accordingly, in order to properly control the sequencers, it is necessary to provide a complex program.

When sequencers are switched with an existing operating system (OS) or a scheduler through a multi-task process, it is possible to control the sequencers relatively easily. However, it is necessary to provide a large capacity memory (read only memory, ROM, or random access memory, RAM) to provide such an OS or a scheduler. In particular, it is difficult to provide an OS in a compact MIDI player such as a melody player of a mobile phone.

Patent Reference 1; Japanese Patent Publication (Kokai) No. 2001-51678

In view of the problems described above, an object of the present invention is to provide a music player capable of controlling a plurality of sequencers with a simple program without an OS or a scheduler.

Further objects and advantages of the invention will be apparent from the following description of the invention.

SUMMARY OF THE INVENTION

In order to attain the objects described above, according to the present invention, a music player is capable of properly switching a plurality of sequencers to play music in a plurality of channels. Each of the sequencers includes a reading and restoring function unit for reading music information including header information, a delta time, and a message from an input memory and restoring running status of the message; a message analyzing and processing function unit for analyzing the header information input from the reading and restoring function unit, consuming a period of time according to the delta time, and analyzing and processing the message to generate sound source drive information; a writing function unit for writing the sound source drive information generated in the message analyzing and processing function unit into an output memory; and a sequencer controlling function unit for controlling the reading and restoring function unit to read and restore the music information, controlling the message analyzing and processing function unit to analyze the header information, and controlling the message analyzing and processing function unit and the writing function unit to consume the period of time, generate the sound source drive information, and write the sound source drive information, respectively, when the header information is proper.

When the sequencers are switched to operate, a part or a whole part of an operational state of each of the function units is maintained per each of the function units while each of the function units stops an operation.

In the present invention, each of the sequencers includes the reading and restoring function unit; the message analyzing and processing function unit; the writing function unit; and the sequencer controlling function unit. Each of the function units is controlled separately. Accordingly, it is possible to control the sequencers with a simple program without an OS or a scheduler.

BRIEF DESCRIPTION OF THE DRAWINGS

FIGS. 7(A) to 7(C) are charts showing analyzing and processing states of a reading and restoring function unit, a message analyzing and processing function unit, and the sequencer controlling function unit shown in FIG. 2.

DETAILED DESCRIPTION OF PREFERRED EMBODIMENTS

Figure 1:
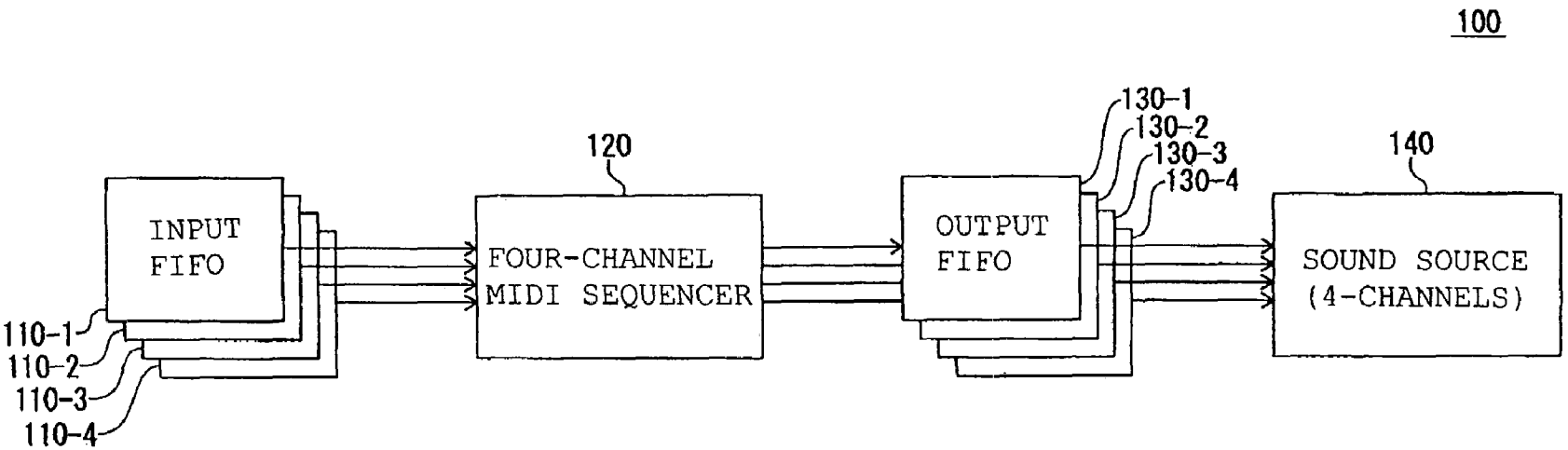
FIG. 1 is a schematic block diagram showing a structure of a MIDI player according to an embodiment of the present invention.

Hereunder, embodiments of the present invention will be explained with reference to the accompanying drawings. In the drawings, a size, a shape, and an arrangement of constituting components are schematically shown for explanation of the present invention. Numerical conditions described in the following description are just an example.

FIG. 1 is a schematic block diagram showing a structure of a four-channel MIDI player according to an embodiment of the present invention. As shown in FIG. 1, according to an embodiment of the present invention, a MIDI player 100 includes four input FIFOs 110-1 to 110-4; a four-channel MIDI sequencer 120; four output FIFOs 130-1 to 130-4; and a single sound source 140.

The input FIFOs 110-1 to 110-4 receive music information in corresponding channels from outside, and temporarily store the music information. The input FIFOs 110-1 to 110-4 typically have a memory capacity of, for example, 256 bites. The four-channel MIDI sequencer 120 receives MIDI data of the four channels from the input FIFOs 110-1 to 110-4, respectively, and analyzes and processes the MIDI data per channel to generate sound source drive information.

The output FIFOs 130-1 to 130-4 receive the sound source drive information of a corresponding channel from the four-channel MIDI sequencer 120, and temporarily store the sound source drive information. The output FIFOs 130-1 to 130-4 typically have a memory capacity of, for example, 32 bites. The sound source 140 includes sound sources for the four channels. The sound source 140 receives the sound source drive information from the output FIFOs 130-1 to 130-4, and generates an analog sound signal for driving a speaker (not shown) according to the sound source drive information.

Figure 2:
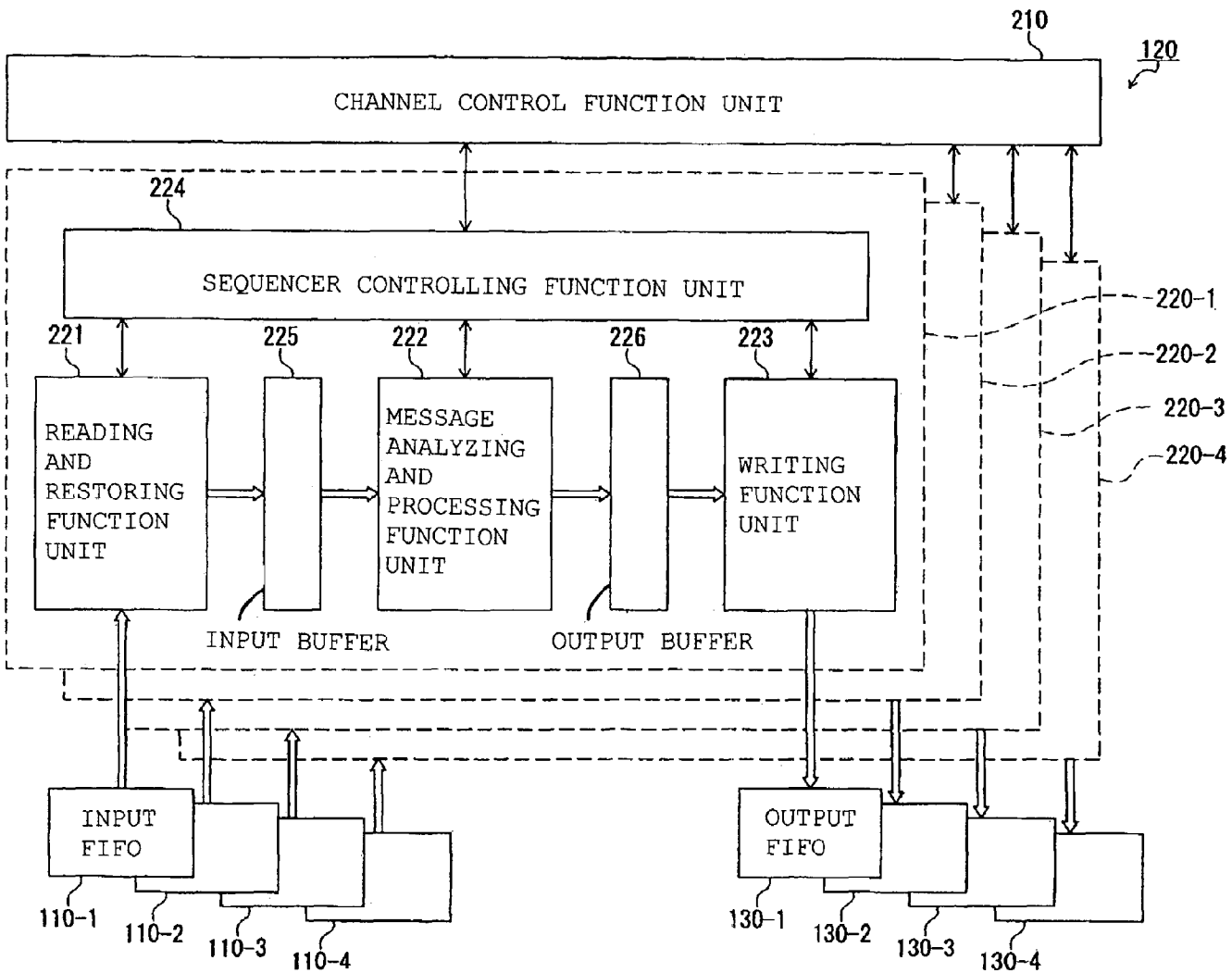
FIG. 2 is a schematic block diagram showing a structure of a four-channel sequencer of the MIDI player shown in FIG. 1.

FIG. 2 is a schematic block diagram showing a structure of the four-channel sequencer 120. As shown in FIG. 2, the four-channel sequencer 120 includes a single channel control function unit 210; and four sequencers 220-1 to 220-4. Each of the sequencers 220-1 to 220-4 includes a reading and restoring function unit 221; a message analyzing and processing function unit 222; a writing function unit 223; a sequencer controlling function unit 224; an input buffer 225; and an output buffer 226.

In the embodiment, the function units 210 and 221 to 224 are formed as firmware with a single CPU (not shown). That is, the function units 210 and 221 to 224 are not formed on an OS as software, but are formed directly on hardware as software. The channel control function unit 210 properly switches and operates the sequencers 220-1 to 220-4. Accordingly, it is possible to play music in four channels.

The reading and restoring function unit 221 receives the MIDI data from a corresponding input FIFO (in a case of the sequencer 220-1, the input FIFO 110-1). Further, the reading and restoring function unit 221 restores running status of an MIDI message. The running status is technology for eliminating status bites of a second MIDI message and after to reduce an amount of transfer data when a plurality of continuous MIDI messages contains a same status bite (bite representing a type of MIDI message). The reading and restoring function unit 221 restores the eliminated status bites to restore the MIDI messages before the running status.

Further, the reading and restoring function unit 221 may determine whether the music information is the MIDI messages. When the music information is not the MIDI messages, the music information may be converted to the MIDI messages. Accordingly, among analyses and processes of the music information, the reading and restoring function unit 221 performs an analysis and a process regarding a data structure and a data format of the music information. Further, the reading and restoring function unit 221 controls a state of own analysis and process, and stores the state as necessary (described later with reference to FIG. 7(A)).

The message analyzing and processing function unit 222 analyzes header information of the MIDI data input from the reading and restoring function unit 221, and analyzes and processes a message stored in the MIDI data to generate the sound source drive information. That is, among the analyses and the processes of the music information (the MIDI data), the message analyzing and processing function unit 222 performs an analysis and a process for generating the sound source drive information according to contents of the message stored in the music information the music information. Further, the message analyzing and processing function unit 222 controls a state of own analysis and process, and stores the state as necessary (described later with reference to FIG. 7(B)).

The writing function unit 223 writes the sound source drive information generated in the message analyzing and processing function unit 222 into a corresponding output FIFO (in a case of the sequencer 220-1, the output FIFO 130-1). Since the writing function unit 223 simply writes data in the output buffer 226 into the output FIFO 130-1, it is not necessary to control a state of own analysis and process (described later).

The sequencer controlling function unit 224 controls the reading and restoring function unit 221 to obtain the header information, and controls the message analyzing and processing function unit 222 to analyze the header information. When the header information is normal, the sequencer controlling function unit 224 controls the message analyzing and processing function unit 222 and the writing function unit 223 to repeat consuming a period of time according to a delta time, generating the sound source drive information according to the message, and writing the sound source drive information into the output FIFO 130-1 to 130-4. Further, the sequencer controlling function unit 224 controls a state of own analysis and process, and stores the state as necessary (described later with reference to FIG. 7(C)).

Figure 3:
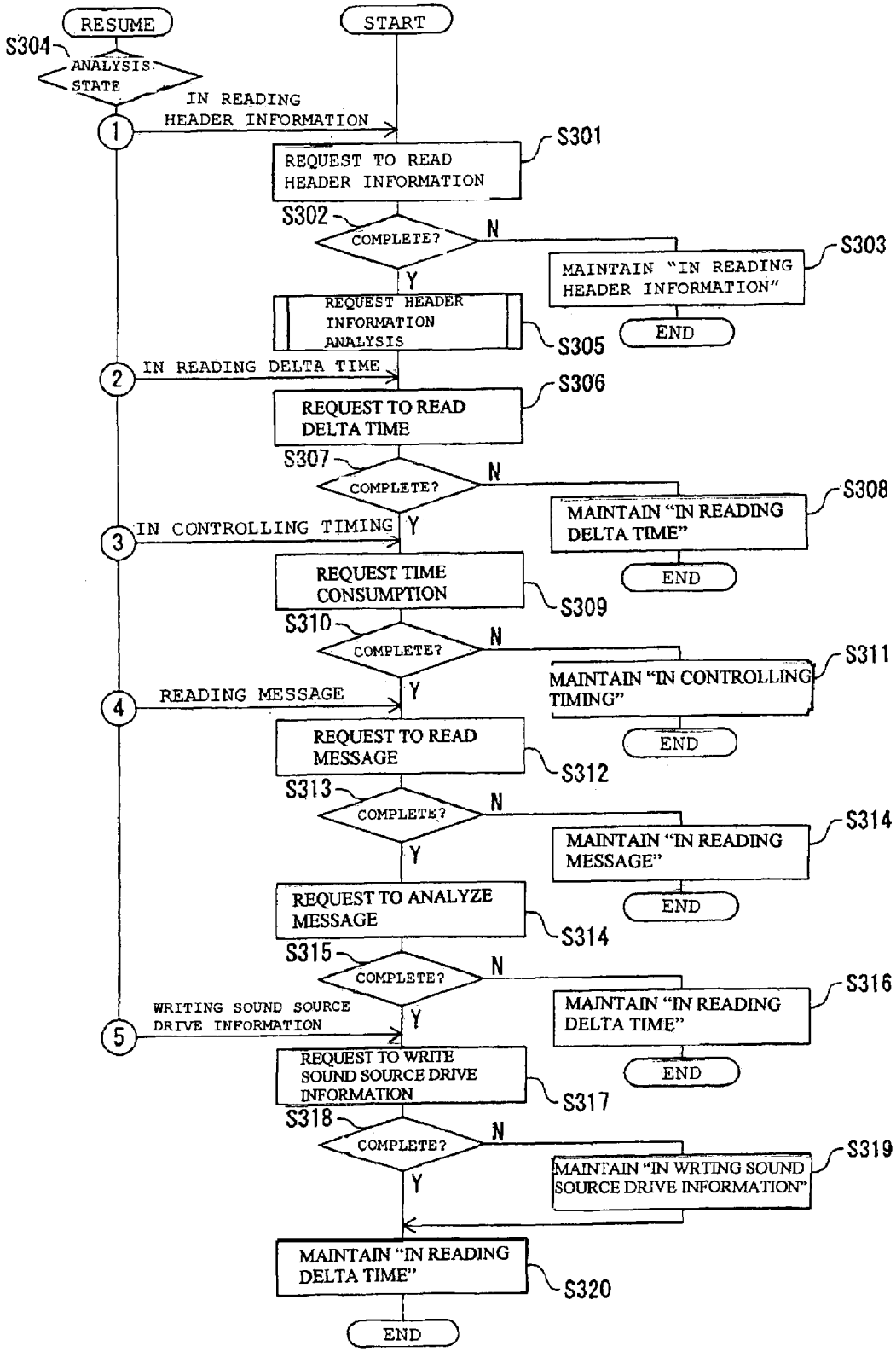
FIG. 3 is a flow chart showing an operation of a sequencer controlling function unit shown in FIG. 2.
Figure 4:
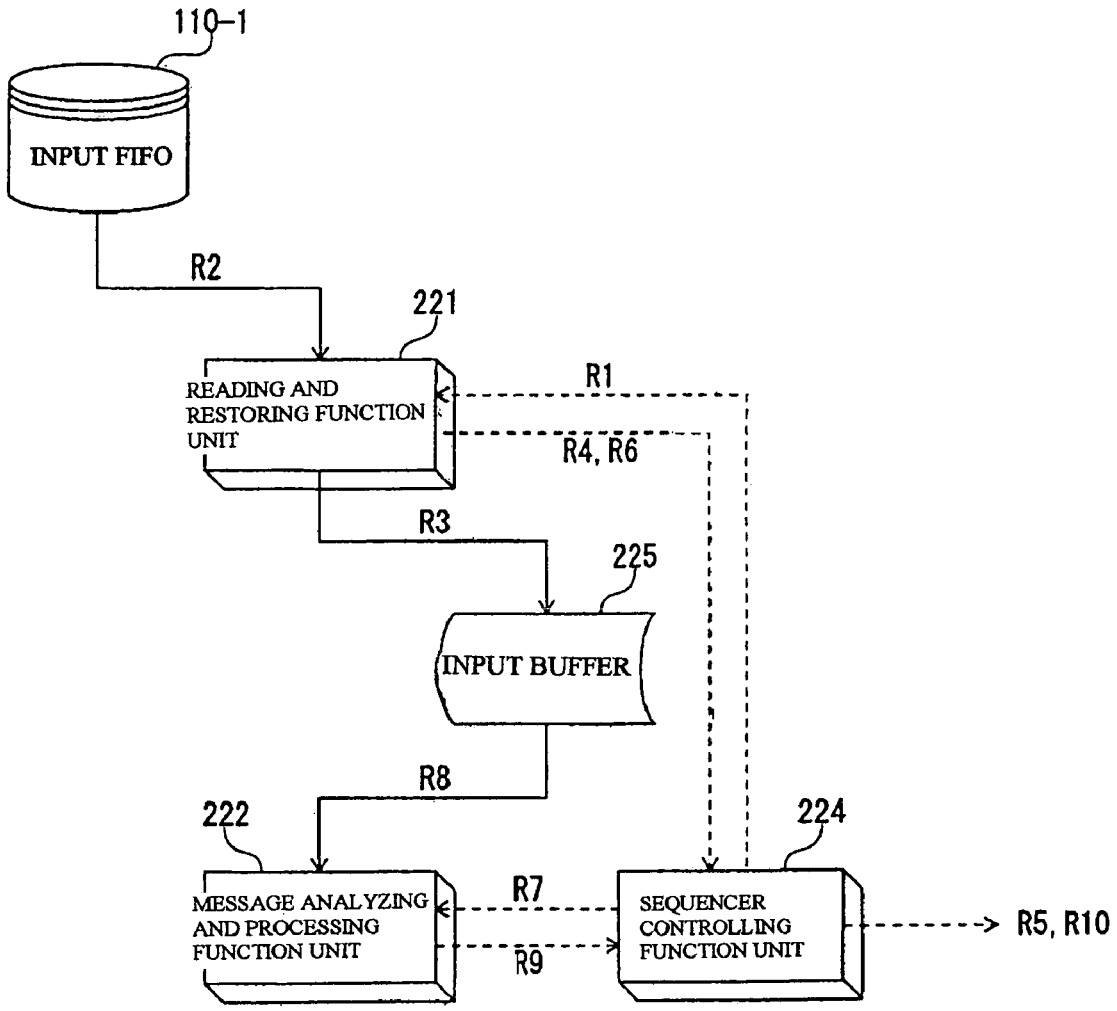
FIG. 4 is a schematic block diagram showing a header analyzing process of the MIDI player according to the embodiment of the present invention.
Figure 5:
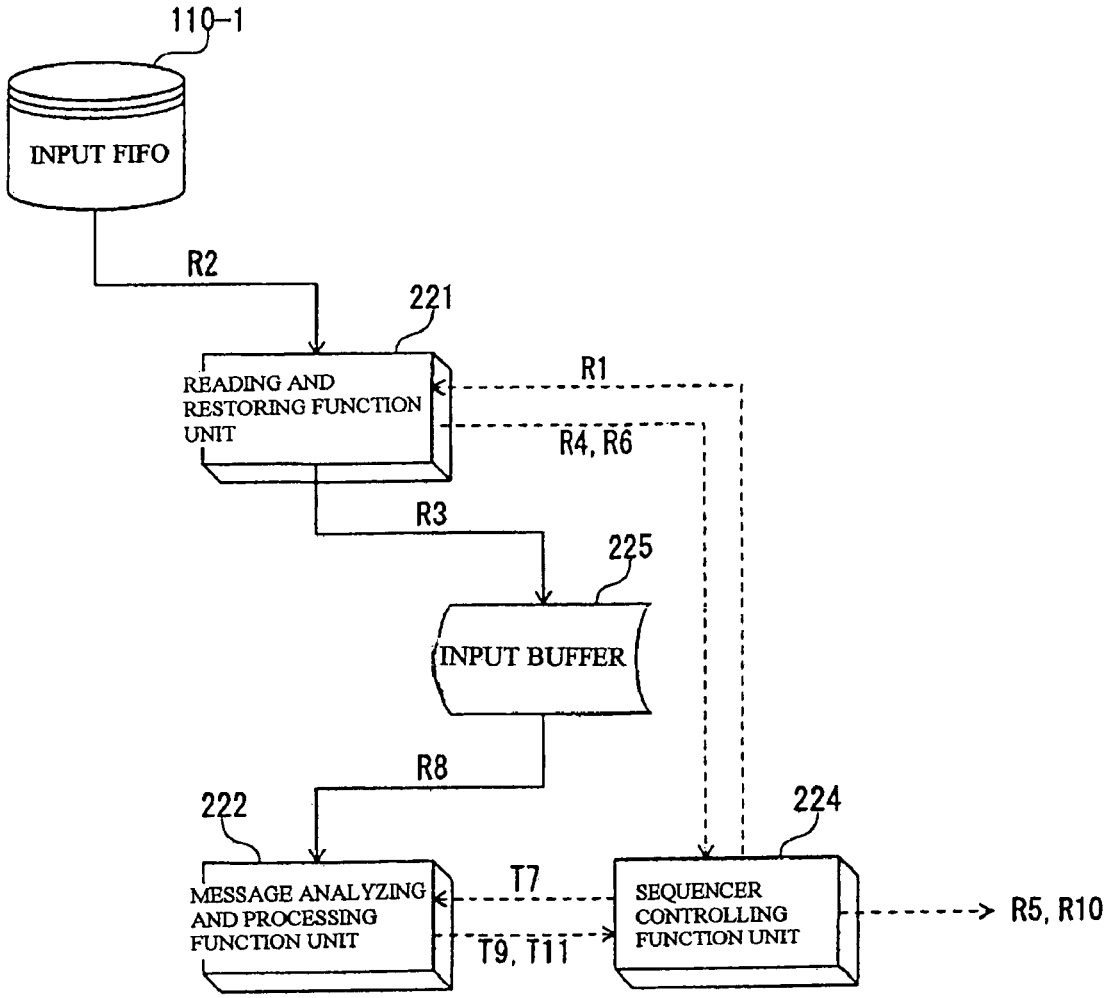
FIG. 5 is a schematic block diagram showing a timing controlling process of the MIDI player according to the embodiment of the present invention.
Figure 6:
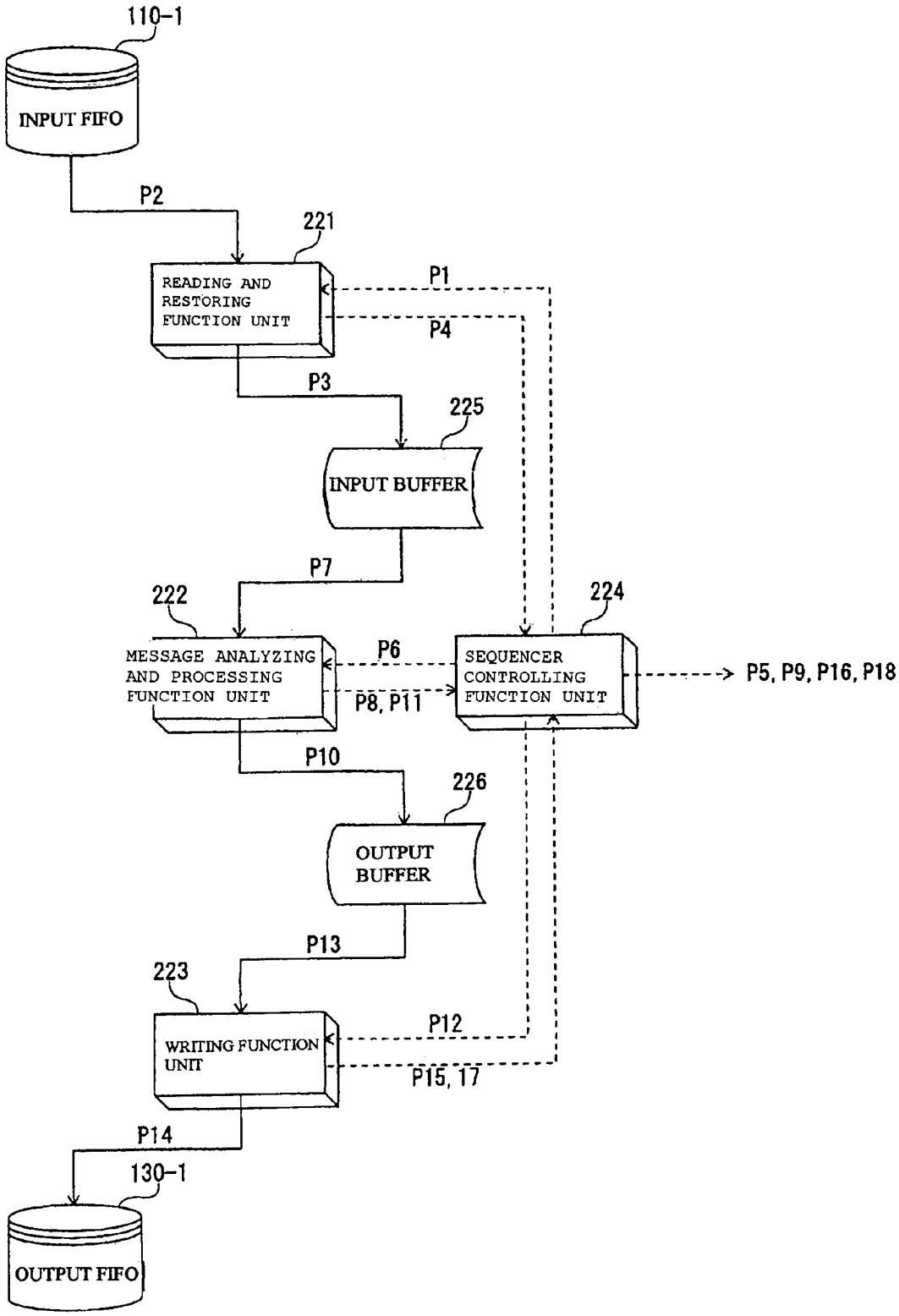
FIG. 6 is a schematic block diagram showing a generating and writing process of sound source drive information of the MIDI player according to the embodiment of the present invention.

An operation of the MIDI player 100 according to the embodiment of the present invention will be explained next in terms of a header analyzing process, a timing controlling process, and a sound source drive information generating and writing process. FIGS. 3 to 7(A)-7(C) are views showing the operation of the MIDI player 100. FIG. 3 is a flow chart showing an operation of the sequencer controlling function unit 224. FIG. 4 is a schematic block diagram for explaining the header analyzing process. FIG. 5 is a schematic block diagram for explaining the timing controlling process. FIG. 6 is a schematic block diagram for explaining the sound source drive information generating and writing process. FIGS. 7(A) to 7(C) are charts showing states of the reading and restoring function unit 221, the message analyzing and processing function unit 222, and the sequencer controlling function unit 224.

In the following description, an operation of the sequencer 220-1 will be explained as an example. Operations of the sequencers 220-2 to 220-4 are the same as that of the sequencer 220-1.

Header Analyzing Process

When the four-channel MIDI sequencer 120 starts operating (FIG. 1), the channel control function unit 210 starts the sequencer 210-1 to operate (FIG. 2), so that the sequencer 220-1 starts the header analyzing process. In the header analyzing process, the sequencer controlling function unit 224 requests the reading and restoring function unit 221 to read the header information (S301 in FIG. 3, R1 in FIG. 4). When the reading and restoring function unit 221 receives the request, the reading and restoring function unit 221 reads data constituting the header information one bite at a time from the input FIFO 110-1, and sequentially stores the data in the input buffer 225 (R2, R3 in FIG. 4) .

When a part or all of the bites of the header information is not stored, the reading and restoring function unit 221 is not capable of performing the reading process. In this case, the reading and restoring function unit 221 maintains a state "In reading header information" as analysis and process status, and holds the number of the bites of the header information that the reading and restoring function unit 221 has read (FIG. 7(A)). When the reading and restoring function unit 221 maintains the state, a status value, for example, may be stored in a memory in hardware constituting the sequencers, or a flag and the like may be formed with software. Alternatively, other methods may be adopted as far as the sequencer 220-1 can check the analysis and process status after the operation is resumed.

In the next step, the reading and restoring function unit 221 sends a message signal to the sequencer controlling function unit 224 indicating that the reading of the header information is stopped before completion (R4 in FIG. 4). Upon receiving the message signal, the sequencer controlling function unit 224 recognizes that the reading of the header information is stopped before completion (S302 in FIG. 3). After the sequencer controlling function unit 224 maintains "In reading header information" as the analysis and process status (S303 in FIG. 3, FIG. 7(C)), the sequencer controlling function unit 224 sends a message signal to the channel control function unit 210 (FIG. 2) indicating that the process is finished (R5 in FIG. 4), thereby completing the reading process of the header information.

Upon receiving the message signal, the channel control function unit 210 stops the operation of the sequencer 220-1, and starts an operation of the sequencer 220-2. After operations of the sequencers 220-2 to 220-4 are performed, the reading and restoring function unit 221 starts the operation of the sequencer 220-1 again. At this time, the sequencer controlling function unit 224 determines that the operation of the sequencer 220-1 stops before the reading of the header information is completed based on the analysis and process status ("In reading header information") (S304 in FIG. 3). Then, the sequencer controlling function unit 224 sends the request to the reading and restoring function unit 221 to read the header information one more time (R1 in FIG. 4). Upon receiving the request, the reading and restoring function unit 221 recognizes the state when the process is stopped ("In reading header information" and the number of the bites that the reading and restoring function unit 221 has read), and starts reading remaining bites.

When the reading is completed, the reading and restoring function unit 221 sends a message signal to the sequencer controlling function unit 224 indicating that the reading is completed (R6 in FIG. 4). Upon receiving the message signal (S302 in FIG. 3), the sequencer controlling function unit 224 requests the message analyzing and processing function unit 222 to analyze the header information (S305 in FIG. 3, R7 in FIG. 4).

Upon receiving the request, the message analyzing and processing function unit 222 reads the header information from the input buffer 225 and analyzes the header information (R8 in FIG. 4). Then, the message analyzing and processing function unit 222 sends a message signal to the sequencer controlling function unit 224 indicating whether the header information is normal or abnormal (whether data has a format that the MIDI player 100 can play) (R9 in FIG. 4). When the header information is abnormal, the sequencer controlling function unit 224 sends a message signal to the channel control function unit 210 indicating the completion of the analysis and process, thereby stopping the operation. When the header information is normal, the sequencer controlling function unit 224 proceeds to the timing controlling process.

Timing Controlling Process

In the timing controlling process, first, the sequencer controlling function unit 224 requests the reading and restoring function unit 221 to read the delta time (S306 in FIG. 3, T1 in FIG. 5). The delta time is information specifying a time interval between one play operation and a next play operation. For example, a time from a note-on (pressing a key) to a note-off (releasing from the key) is defined by the delta time. Upon receiving the request, the reading and restoring function unit 221 reads the delta time one bite at a time from the input FIFO 110-1, and sequentially stores the delta time in the input buffer 225 (T2 and T3 in FIG. 5).

When a part or all of the bites of the delta time is not stored, the reading and restoring function unit 221 is not capable of performing the reading process. In this case, the reading and restoring function unit 221 maintains a state "In reading delta time" as analysis and process status, and holds the number of the bites of the delta time that the reading and restoring function unit 221 has read (FIG. 7(A)). Then, the reading and restoring function unit 221 sends a message signal to the sequencer controlling function unit 224 indicating that the reading of the delta time is stopped before completion (T4 in FIG. 5). Upon receiving the message signal, the sequencer controlling function unit 224 recognizes that the reading of the delta time is stopped before completion (S307 in FIG. 3). After the sequencer controlling function unit 224 maintains "In reading delta time" as the analysis and process status (S308 in FIG. 3, FIG. 7(C)), the sequencer controlling function unit 224 sends a message signal to the channel control function unit 210 (FIG. 2) indicating that the process is finished (T5 in FIG. 5), thereby completing the reading process of the header information.

Upon receiving the message signal, the channel control function unit 210 stops the operation of the sequencer 220-1, and starts an operation of the sequencer 220-2. After operations of the sequencers 220-2 to 220-4 are performed, the reading and restoring function unit 221 starts the operation of the sequencer 220-1 again. At this time, the sequencer controlling function unit 224 determines that the operation of the sequencer 220-1 stops before the reading of the delta time is completed based on the analysis and process status ("In reading delta time") (S304 in FIG. 3). Then, the sequencer controlling function unit 224 sends the request to the reading and restoring function unit 221 to read the delta time one more time (S306 in FIG. 3, T1 in FIG. 5). Upon receiving the request, the reading and restoring function unit 221 recognizes the state when the process is stopped ("In reading delta time" and the number of the bites that the reading and restoring function unit 221 has read), and starts reading remaining bites.

When the reading is completed, the reading and restoring function unit 221 sends a message signal to the sequencer controlling function unit 224 indicating that the reading is completed (T6 in FIG. 5). Upon receiving the message signal, the sequencer controlling function unit 224 requests the message analyzing and processing function unit 222 to consume a period of time corresponding to the delta time (S309 in FIG. 3, T7 in FIG. 5).

Upon receiving the request, the message analyzing and processing function unit 222 reads the delta time from the input buffer 225 (T8 in FIG. 5). Then, the message analyzing and processing function unit 222 compares the delta time with a time of an internal timer (not shown) as necessary to control status of time consumption. When the time consumption is not completed within a specific period of time, the message analyzing and processing function unit 222 maintains a state "In consuming delta time" as the analysis and process status, and holds the consumed time (FIG. 7(B)).

In the next step, the message analyzing and processing function unit 222 sends a message signal to the sequencer controlling function unit 224 indicating that the time consumption is stopped before completion (T9 in FIG. 5). Upon receiving the message signal, the sequencer controlling function unit 224 recognizes that the time consumption is stopped before completion (S310 in FIG. 3). After the sequencer controlling function unit 224 maintains "In controlling timing" as the analysis and process status (S311 in FIG. 3, FIG. 7(C)), the sequencer controlling function unit 224 sends a message signal to the channel control function unit 210 (FIG. 2) indicating that the process is finished (T10 in FIG. 5), thereby completing the timing controlling process.

Upon receiving the message signal, the channel control function unit 210 stops the operation of the sequencer 220-1, and starts an operation of the sequencer 220-2. After operations of the sequencers 220-2 to 220-4 are performed, the reading and restoring function unit 221 starts the operation of the sequencer 220-1 again. At this time, the sequencer controlling function unit 224 determines that the operation of the sequencer 220-1 stops before the consumption of the delta time is completed based on the analysis and process status ("In controlling timing") (S304 in FIG. 3). Then, the sequencer controlling function unit 224 sends the request to the message analyzing and processing function unit 222 to consume time one more time (T7 in FIG. 5). Upon receiving the request, the message analyzing and processing function unit 222 recognizes the state when the process is stopped ("In consuming delta time" and the consumed time), and starts consuming the delta time.

When the consumption of the delta time is completed, the message analyzing and processing function unit 222 sends a message signal to the sequencer controlling function unit 224 indicating that the consumption is completed (R11 in FIG. 5). Upon receiving the message signal (S310 in FIG. 3), the sequencer controlling function unit 224 recognizes the completion of the time consumption (S310 in FIG. 3), and the process proceeds to the sound source drive information generating and writing process.

Sound Source Drive Information Generating and Writing Process

In the sound source drive information generating and writing process, first, the sequencer controlling function unit 224 requests the reading and restoring function unit 221 to read the message (S312 in FIG. 3, P1 in FIG. 6). Upon receiving the request, the reading and restoring function unit 221 reads the message one bite at a time from the input FIFO 110-1, and sequentially stores the message in the input buffer 225 (P2 and P3 in FIG. 6). When the conversion function converts data from a format other than MIDI to the MIDI format, the reading and restoring function unit 221 converts the data, and then stores the data in the input buffer 225.

When a part or all of the bites of the message is not stored in the input FIFO 110-1, the reading and restoring function unit 221 is not capable of performing the reading process. In this case, the reading and restoring function unit 221 maintains a state "In reading message (type not identified", "In reading message (three bites message)", "In reading message (meta event)", or "In reading message (system exclusive message)" as the analysis and process status, and holds the number of the bites of the message that the reading and restoring function unit 221 has read (FIG. 7(A)). A type of the message is maintained, so that the remaining bites are determined in a different process according to the type.

Then, the reading and restoring function unit 221 sends a message signal to the sequencer controlling function unit 224 indicating that the reading of the message is stopped before completion (P4 in FIG. 6). Upon receiving the message signal, the sequencer controlling function unit 224 recognizes that the reading of the message is stopped before completion (S313 in FIG. 3). After the sequencer controlling function unit 224 maintains "In reading message" as the analysis and process status (FIG. 7(C)), the sequencer controlling function unit 224 sends a message signal to the channel control function unit 210 (FIG. 2) indicating that the process is finished (P5 in FIG. 6), thereby completing the reading process of the message.

Upon receiving the message signal, the channel control function unit 210 stops the operation of the sequencer 220-1, and starts an operation of the sequencer 220-2. When the operation of the sequencer 220-1 starts again, the sequencer controlling function unit 224 determines that the operation of the sequencer 220-1 stops before the reading of the message is completed based on the analysis and process status ("In reading message (type not identified)" and the like) and the type of the message (or unidentified state thereof) (S304 in FIG. 3). Then, the sequencer controlling function unit 224 sends the request to the reading and restoring function unit 221 to read the message one more time (P1 in FIG. 6). Upon receiving the request, the reading and restoring function unit 221 recognizes the state when the process is stopped ("In reading message" and the number of the bites that the reading and restoring function unit 221 has read), and starts reading the remaining bites.

When the reading of the message is completed, the reading and restoring function unit 221 sends a message signal to the sequencer controlling function unit 224 indicating that the reading is completed (P4 in FIG. 6). Upon receiving the message signal (S313 in FIG. 3), the sequencer controlling function unit 224 requests the message analyzing and processing function unit 222 to analyze the message (S314 in FIG. 3, P6 in FIG. 6).

Upon receiving the request, the message analyzing and processing function unit 222 reads the MIDI data from the input buffer 225 and analyzes the same (P7 in FIG. 6). When the message is abnormal (message not compatible with the sound source 140), the message analyzing and processing function unit 222 deletes the message from the input buffer 225, and sends a message signal to the sequencer controlling function unit 224 indicating the deletion (P8 in FIG. 6). Upon recognizing that the message signal is abnormal (S315 in FIG. 3), the sequencer controlling function unit 224 maintains a state "In reading delta time" as the analysis and process status (S316 in FIG. 3), and sends a message signal to the channel control function unit 210 indicating that the process is finished (P9 in FIG. 6), thereby completing the process. Through maintaining the state "In reading delta time" as the analysis and process status, the timing controlling process is performed upon resuming the operation of the sequencer 220-1 (S306 to S311 in FIG. 3).

When the message is normal (message compatible with the sound source 140), the message analyzing and processing function unit 222 generates the sound source drive information according to content of the message, and writes the content in the output buffer 226 (P10 in FIG. 6). Then, the message analyzing and processing function unit 222 sends a message signal to the sequencer controlling function unit 224 indicating that the analysis is finished (P11 in FIG. 6). Upon recognizing that the message signal indicates the completion of the analysis (S315 in FIG. 3), the sequencer controlling function unit 224 request the writing function unit 223 to write the sound source drive information in the output FIFO 130-1 (S317 in FIG. 3, P12 in FIG. 6). Upon receiving the request, the writing function unit 223 reads the sound source drive information from the output buffer 226, and stores the same in the output FIFO 130-1 (P13 and P14 in FIG. 6).

When the output FIFO 130-1 runs out a storage space, the writing function unit 223 is not capable of performing the reading process. In this case, the writing function unit 223 sends a message signal to the sequencer controlling function unit 224 indicating that the reading is stopped before completion (P15 in FIG. 6). At this time, the writing function unit 223 does not maintain status, and simply writes data in the output buffer 226 into the output FIFO 130-1. No analysis or process is performed, so that it is not necessary to store status. If necessary, the writing function unit 223 may store status.

Upon receiving the message signal, the sequencer controlling function unit 224 recognizes that the reading of the sound source drive information is stopped before completion (S318 in FIG. 3). After the sequencer controlling function unit 224 maintains "In writing sound source drive information" as the analysis and process status (FIG. 7(C)), the sequencer controlling function unit 224 sends a message signal to the channel control function unit 210 (FIG. 2) indicating that the process is finished (P16 in FIG. 6), thereby completing the process.

Upon receiving the message signal, the channel control function unit 210 stops the operation of the sequencer 220-1, and starts an operation of the sequencer 220-2. When the operation of the sequencer 220-1 starts again, the sequencer controlling function unit 224 determines that the operation of the sequencer 220-1 stops before the reading of the sound source drive information is completed based on the analysis and process status ("In writing sound source drive information") (S304 in FIG. 3). Then, the sequencer controlling function unit 224 sends the request to the reading and restoring function unit 221 to write the sound source drive information one more time (P12 in FIG. 6). Upon receiving the request, the writing function unit 223 starts writing data in the output buffer 226 into the output FIFO 130-1.

When the writing is completed, the writing function unit 223 sends a message signal to the sequencer controlling function unit 224 indicating that the writing is completed (P17 in FIG. 6). Upon recognizing that the writing is completed from the message signal (S318 in FIG. 3), the sequencer controlling function unit 224 maintains "In reading delta time" as the analysis and process status, and sends a message signal to the channel control function unit 210 (FIG. 2) indicating that the process is finished (P18 in FIG. 6), thereby completing the process. Through maintaining the state "In reading delta time" as the analysis and process status, the timing controlling process is performed upon resuming the operation of the sequencer 220-1 (S306 to S311 in FIG. 3). Afterward, the timing controlling process and the generation and writing of the sound source drive information are repeated until the MIDI data are played completely.

As described above, each of the sequencers 220-1 to 220-4 includes the reading and restoring function unit 221; the message analyzing and processing function unit 222; the writing function unit 223; and the sequencer controlling function unit 224. The status of analysis and process of each of the function units is controlled and stored separately, thereby making control and storage items simple (FIGS. 7(A) to 7(C)). Accordingly, it is possible to control a plurality of sequencers with a simple program without an OS or a scheduler. As a result, it is possible to reduce a memory capacity. Further, the reading and restoring function unit 221 is arranged as a independent unit separate from other units. Accordingly, it is easy to add the function of converting a format other than MIDI to the MIDI format.

The disclosure of Japanese Patent Application No. 2004-367544, filed on Dec. 20, 2004, is incorporated in the application.

While the invention has been explained with reference to the specific embodiments of the invention, the explanation is illustrative and the invention is limited only by the appended claims.

What is claimed is:

1. A music player comprising:

a plurality of sequencers to be switched for playing music in a plurality of channels, each of said plurality of the sequencers including, a reading and restoring function unit for reading music information including header information, a delta time, and a message from an input memory and restoring running status of the message;

a message analyzing and processing function unit for analyzing the header information input from the reading and restoring function unit, consuming a period of time according to the delta time, and analyzing and processing the message to generate sound source drive information;

a writing function unit for writing the sound source drive information generated in the message analyzing and processing function unit into an output memory; and a sequencer controlling function unit for controlling the reading and restoring function unit to read and restore the music information, controlling the message analyzing and processing function unit to analyze the header information, and controlling the message analyzing and processing function unit and the writing function unit to consume the period of time, generate the sound source drive information, and write the sound source drive information, respectively, when the header information is normal, wherein when said plurality of the sequencers is switched, a part or a whole part of an operational state of each of the reading and restoring function unit, the message analyzing and processing function unit, the writing function unit, and the sequencer controlling function unit is maintained per said each of the reading and restoring function unit, the message analyzing and processing function unit, the writing function unit, and the sequencer controlling function unit while said each of the reading and restoring function unit, the message analyzing and processing function unit, the writing function unit, and the sequencer controlling function unit stops operating.

2. A music player according to claim 1, wherein said reading and restoring function unit in one of the plurality of the sequencers maintains information distinguishing the header information, the delta time, and the message, and an amount of data that the reading and restoring function unit has read as the operational state thereof when the one of the plurality of the sequencers stops operating while the reading and restoring function unit is reading the music information.

3. A music player according to claim 2, wherein said reading and restoring function unit maintains a type of the message as the operational state thereof when the music information is the message while the reading and restoring function unit is reading the music information.

4. A music player according to claim 2, wherein said sequencer controlling function unit maintains information distinguishing operations of reading the header information, reading the delta time, and reading the message as the operational state thereof.

5. A music player according to claim 1, wherein said message analyzing and processing function unit in one of the plurality of the sequencers maintains information indicating that the message analyzing and processing function unit is consuming the period of time and a consumed time as the operational state thereof when the one of the plurality of the sequencers stops operating while the message analyzing and processing function unit is consuming the period of time.

6. A music player according to claim 5, wherein said sequencer controlling function unit maintains information indicating that the sequencer controlling function unit is controlling timing as the operational state thereof.

7. A music player according to claim 1, wherein said sequencer controlling function unit in one of the plurality of the sequencers maintains information indicating that the writing function unit is writing the sound source drive information as the operational state thereof when the one of the plurality of the sequencers stops operating while the writing function unit is writing the sound source drive information.

8. A music player according to claim 1, wherein said reading and restoring function unit further includes a function unit for converting a format of the music information to another format compatible with the message analyzing and processing function unit.

* * * * *